US009279212B2

(12) United States Patent
Atac et al.

(10) Patent No.: US 9,279,212 B2
(45) Date of Patent: Mar. 8, 2016

(54) WASHER/DRYER

(75) Inventors: Kenan Atac, Istanbul (TR); Davut Ayhan Serabatir, Istanbul (TR); Erkan Tarakci, Istanbul (TR)

(73) Assignee: Arcelik Anonim Sirketi, Istanbul (TR)

( * ) Notice: Subject to any disclaimer, the term of this patent is extended or adjusted under 35 U.S.C. 154(b) by 871 days.

(21) Appl. No.: 12/521,278

(22) PCT Filed: Dec. 17, 2007

(86) PCT No.: PCT/EP2007/064052

§ 371 (c)(1),
(2), (4) Date: Feb. 2, 2010

(87) PCT Pub. No.: WO2008/077838

PCT Pub. Date: Jul. 3, 2008

(65) Prior Publication Data

US 2010/0139112 A1 Jun. 10, 2010

(30) Foreign Application Priority Data

Dec. 25, 2006 (TR) ..... 2006 07399

(51) Int. Cl.

| | |
|---|---|
| ***D06F 58/28*** | (2006.01) |
| ***D06F 58/02*** | (2006.01) |
| ***D06F 58/20*** | (2006.01) |

(52) U.S. Cl.

CPC ..... *D06F 58/28* (2013.01); *D06F 58/02* (2013.01); *D06F 58/20* (2013.01); *D06F 58/206* (2013.01); *D06F 2058/2864* (2013.01)

(58) Field of Classification Search

CPC ..... D06F 58/02; D06F 58/20; D06F 58/28; D06F 58/206; D06F 2058/2864

USPC ..... 34/72, 73, 76, 77, 78, 596, 134; 62/3.2, 62/3.4

See application file for complete search history.

(56) References Cited

U.S. PATENT DOCUMENTS 7,526,879 B2 * 5/2009 Bae et al. ..... 34/596

FOREIGN PATENT DOCUMENTS

| | | | | |
|---|---|---|---|---|
| DE | 2220425 | A1 | | 11/1973 |
| DE | 4306217 | A1 | | 9/1994 |
| EP | 1205592 | A | | 5/2002 |
| EP | 1342828 | A | | 9/2003 |
| JP | 04087830 | A | * | 3/1992 |
| JP | 08057194 | A | * | 3/1996 |
| WO | 2007/113081 | A | | 10/2007 |

* cited by examiner

*Primary Examiner* — Jiping Lu
(74) *Attorney, Agent, or Firm* — Venjuris P.C.

(57) ABSTRACT

A washer/dryer (1) including a body, a drum arranged inside this body wherein laundry to be washed is emplaced, and a fan that aspirates the humid air generated in the drum during the drying process and a chamber whereto the air aspirated by the fan is delivered, configured as a volute wherein the air can circulate and a thermoelectric module situated in the chamber and having flaps that control the flow rate of the air that flows over the thermoelectric module so that the washer/dryer has high efficiency and decreases the noise generated during the drying cycle.

4 Claims, 1 Drawing Sheet

WASHER/DRYER

FIELD OF THE INVENTION

The present invention relates to a washer/dryer that is more efficient and operates with less noise.

BACKGROUND

In washer/dryers, the fan used for cooling the condenser generates noise during the drying cycle of the laundry. In order to avoid this problem, a thermoelectric module is utilized instead of the condenser in the drying process. In this system, the humid air received by means of a fan from the drum wherein laundry is emplaced, is aspirated into a chamber. A thermoelectric module is provided in the chamber. The air dehumidified by the thermoelectric module and at least partially heated is sent to the drum either directly or after the employment of a preheating process.

In the state of the art European Patent Application No EP 1342828, the use of the hot surface of a thermoelectric module in the drying cycle of a washing machine is described.

In the state of the art Japanese Patent Application No JP 8057194, a housing, situated inside a washing machine, having air inlet ducts on both sides and also wherein a Peltier element is provided, is mentioned.

In these state of the art applications, since using a fan is not required to cool the condenser or the fan utilized being smaller than the fans used in washer/dryers not comprising a thermoelectric module and being operated for a shorter period of time, the noise generated decreases. However, if the flow rate of the air passing over the thermoelectric module is high, a decrease in efficiency is observed since air cannot be heated sufficiently.

SUMMARY

The object of the present invention is to design a washer/dryer that reduces the noise generated in the drying cycle and increases efficiency.

The washer/dryer designed to fulfill the objective of the present invention, explicated in the first claim and the respective claims thereof, comprises a body, a drum arranged inside this body wherein laundry to be washed is emplaced, and a fan that aspirates the humid air generated in the drum during the drying process. The washer/dryer furthermore comprises a chamber whereto the air aspirated by the fan is delivered, configured as a volute wherein the air can circulate and a thermoelectric module situated in the chamber. In the chamber, flaps are provided that control the flow rate of the air that flows over the thermoelectric module.

The drying process is comprised of phases wherein the humid air is aspirated from the drum by the fan, delivered into the chamber from the inlet orifice, and by contacting the cold and hot sides of the thermoelectric module in sequence leaves its moisture and is heated and is redelivered inside the drum from here. Meanwhile, the flow rate of the air that will flow over the thermoelectric module is regulated by opening, closing of the flaps that are disposed in the chamber.

In the preferred embodiment of the present invention, the washer/dryer comprises a control unit for controlling the flaps. The control unit opens, closes the flaps according to user preferences or according to values defined for the recorded programs in the memory of the washer/dryer by the producer.

In an embodiment of the present invention, the chamber comprises at least one flap that corresponds to each inlet orifice.

In an embodiment of the present invention, the chamber comprises guides that direct the air to directly proceed over the cold and hot sides of the thermoelectric element before going towards the corners since drying performance will be decreased by corner losses when the air proceeds up to the corners during the circulation of the air in the chamber.

In another embodiment of the present invention, the air is received into the chamber by at least two inlet orifices but discharged out by only one outlet orifice. In this embodiment, by using more than one thermoelectric module, the outlet orifice is disposed to remain between the thermoelectric modules and the inlet orifices.

The control unit utilized in another embodiment of the present invention also controls the flow directed to the thermoelectric modules as well as the movement of the flaps. In this embodiment, different airflows are directed to the thermoelectric modules in accordance with user preferences or as per the requirements of the washer/dryer program thus maintaining effective control of the drying process.

The washer/dryer of the present invention, provides a noiseless and efficient drying process to be implemented.

BRIEF DESCRIPTION OF THE DRAWINGS

The washer/dryer designed to fulfill the objective of the present invention is illustrated in the attached figures, where.

DETAILED DESCRIPTION

Figure 1:
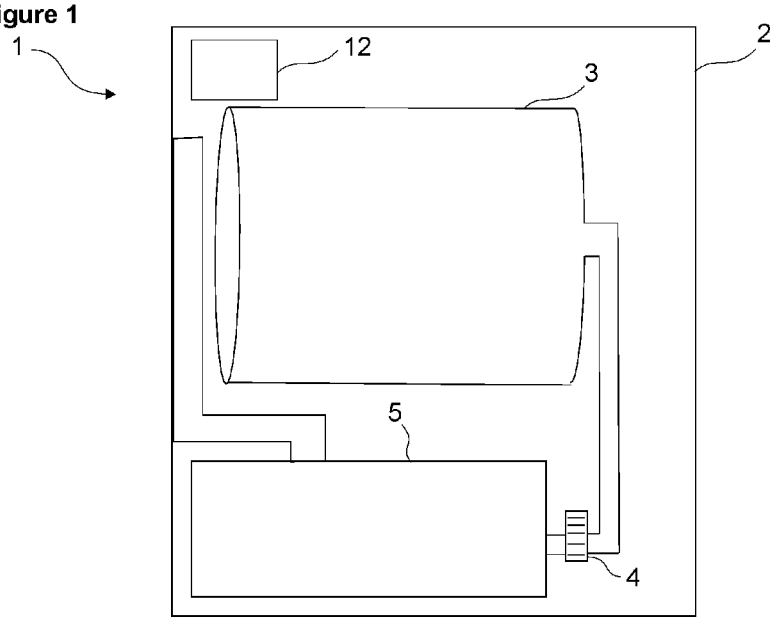
FIG. 1—is the schematic view of a washer/dryer.
Figure 2:
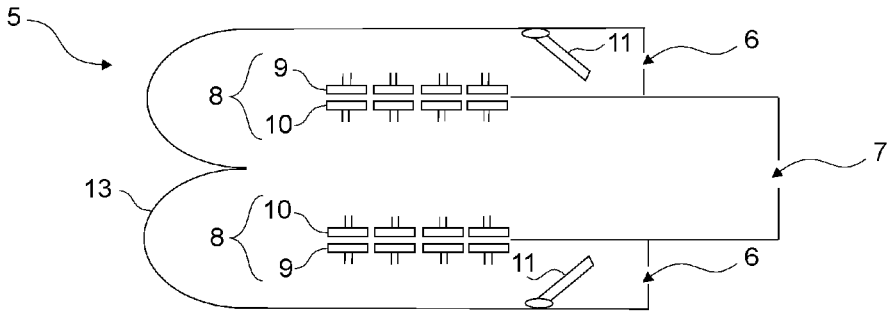
FIG. 2—is the schematic view of a chamber.
Figure 3:
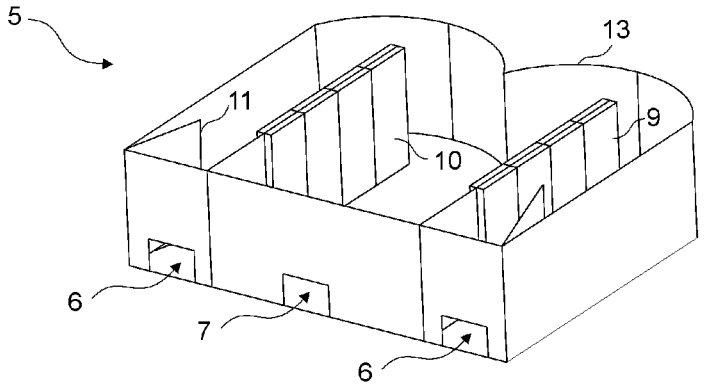
FIG. 3—is another the schematic view of the chamber.

The elements illustrated in the figures are numbered as follows:

1. Washer/dryer
2. Body
3. Drum
4. Fan
5. Chamber
6. Inlet orifice
7. Outlet orifice
8. Thermoelectric module
9. Cold side
10. Hot side
11. Flap
12. Control unit
13. Guide The washer/dryer (1) comprises:

a body (2), a drum (3) situated inside the body (2), wherein the laundry is emplaced, a fan (4) that aspirates the humid air generated in the drum (3), a chamber (5) configured as a volute wherein the air aspirated by the fan (4) can circulate, a volute shaped chamber (5) wherein the air aspirated by the fan (4) can circulate, at least one inlet orifice (6) allowing inflow of air into the chamber (5), at least one outlet orifice (7) allowing discharge of air, at least one thermoelectric module (8) disposed in the chamber (5), having a cold side (9) that condensates the moisture by absorbing the heat in the surroundings for removing the moisture of the air received into the chamber (5) and a hot side (10) that heats the dehumidified dry air, and at least one flap (11) disposed in the chamber (5) that controls the flow rate of the air flowing over the thermoelectric module (8).

The humid air aspirated from the drum (3) during the drying process by means of the fan (4) reaches inside the chamber (5) passing through the inlet orifice (6). Inside the chamber (5), the air passes over the thermoelectric module (8) at a certain flow rate depending on the opening of the flaps (11). The air that contacts first with the cold side (9) of the thermoelectric module (8) leaves its moisture, and then is heated by reaching the hot side (10) of the thermoelectric module (8) due to the volute shape of the chamber (5). The heated air passes through the outlet orifice (7) to be delivered again to the drum (3).

The washer/dryer (1) furthermore comprises a control unit (12) that controls the flaps (11) situated in the chamber (5). The control unit (12) can adjust the flaps (11) and thus the flow rate of the air that passes over the thermoelectric module (8) in accordance with the operating drying program or according to the selections made by the user. For example, in the case that less wet laundry is dried, the flaps (11) can be changed to an entirely open position for completing the drying process in a short while. On the other hand, in case very wet laundry is dried, the flaps (11) are changed to partially closed position providing the air passing over the thermoelectric module (8) to be heated more effectively.

In another embodiment of the present invention, the chamber (5) comprises guides (13) that direct the air circulating in the chamber (5) and prevent the corner losses.

In a version of this embodiment, the guides (13) are shaped like semicircles. Accordingly, the air circulating in the chamber (5) is prevented from slowing down by proceeding up to the corners and efficiency is thus increased.

In another embodiment of the present invention, the chamber (5) comprises at least two inlet orifices (6) wherein the air received from the drum (3) by means of the fan (4) enters and at least one outlet orifice (7) through which the heated air leaves to be delivered to the drum (3). In this embodiment, the outlet orifice (7) is preferably positioned to be between the inlet orifices (6). At least two thermoelectric modules (8) are disposed in the chamber (5) such that the hot sides (10) face each other. The shape of the chamber (5) is such that the air received into the chamber (5) will first contact the cold sides (9) of the thermoelectric modules (8) and then will reach the outlet orifice (7) by following the path between the hot sides (10).

In another embodiment of the present invention, the chamber (5) comprises at least one flap (11) that corresponds to each inlet orifice (6).

In another embodiment of the present invention, more than one thermoelectric module (8) is disposed inside the chamber (5). In this embodiment, the control unit (12) regulates the amount of flow delivered to each thermoelectric module (8). Consequently, heating and cooling control can be maintained by delivering different flows to the thermoelectric modules (8) when desired.

The invention claimed is:

1. A washer/dryer comprising a body, a drum situated inside the body, wherein a laundry is emplaced, a fan that aspirates humid air generated in the drum, a chamber configured as a volute wherein the humid air aspirated by the fan can circulate, at least one inlet orifice allowing inflow of the humid air into the chamber, at least one outlet orifice allowing the discharge of air and at least one thermoelectric module disposed in the chamber, having a cold side that contacts the humid air flow condensates the moisture by absorbing the heat in the surroundings for removing the moisture of the humid air received into the chamber and a hot side that subsequently heats the dehumidified dry air for delivery to the drum, and at least one flap disposed in the chamber that controls the flow rate of the air flowing over both the cold side and the hot side of the thermoelectric module and wherein the inlet orifice of the chamber and the outlet orifice of the chamber are connected so that inflow of humid air passes over both the cold side and the hot side of the thermoelectric module before leaving the outlet orifice for the drum, guides that direct the humid air circulating in the chamber and prevent the corner losses, and a control unit that controls the at least one flap and thus the flow rate of the air passing over the thermoelectric module and wherein the at least one inlet orifice allowing inflow of humid air into the chamber is at least two inlet orifices, and wherein the at least one thermoelectric module is at least two thermoelectric modules disposed in the chamber such that the hot side of each of the at least two thermoelectric modules face each other, and wherein the shape of the chamber is such that the air received into the chamber from each of the at least two inlet orifices first contact at least one of the cold side of at least two thermoelectric modules, and wherein the at least one outlet orifice is one outlet orifice that is positioned between a path formed between the hot sides of the at least two thermoelectric modules facing each other.

2. The washer/dryer as in claim 1, wherein the chamber comprising at least two flaps that correspond to each inlet orifice.

3. The washer/dryer in claim 1, wherein the at least two thermoelectric modules are more than two thermoelectric modules and the control unit that supplies different flows to each of these thermoelectric modules for maintaining control of heating and cooling.

4. A washer/dryer comprising: a body, a drum situated inside the body, wherein the laundry is emplaced and which generates humid air, a fan that aspirates the humid air and delivers the humid air to a chamber configured as a volute wherein the chamber includes:

at least one inlet orifice allowing inflow of humid air into the chamber, at least one thermoelectric module having a cold side and a hot side, within the chamber, wherein the cold side contacts and condenses moisture from the humid air forming dehumidified air and, in sequence, the hot side contacts and heats the dehumidified air, at least one outlet orifice that delivers the heated dehumidified air to the drum, and at least one flap disposed in the chamber that controls the flow rate of the humid air flowing over the thermoelectric module and wherein the at least one inlet orifice allowing inflow of humid air into the chamber is at least two inlet orifices, and wherein the at least one thermoelectric module is at least two thermoelectric modules disposed in the chamber such that the hot side of each of the at least two thermoelectric modules face each other, and wherein the shape of the chamber is such that the air received into the chamber from each of the at least two inlet orifices first contact at least one of the cold side of at least two thermoelectric modules, and wherein the at least one outlet orifice is one outlet orifice that is positioned between a path formed between the hot sides of the at least two thermoelectric modules facing each other.

* * * * *